United States Patent [19]

Long, Jr.

[11] Patent Number: 4,884,583

[45] Date of Patent: Dec. 5, 1989

[54] HAIR ROLLER AND ROTATING APPARATUS

[76] Inventor: Oscar C. Long, Jr., 516 Evergreen St. No. 4, Inglewood, Calif. 90302

[21] Appl. No.: 141,962

[22] Filed: Jan. 11, 1988

[51] Int. Cl.[4] ..... A45D 2/00

[52] U.S. Cl. ..... 132/238; 132/254; 132/255

[58] Field of Search ..... 132/238, 239, 242, 271, 132/223, 253, 254, 255

[56] References Cited

U.S. PATENT DOCUMENTS

| | | | |
|---|---|---|---|
| 3,413,984 | 12/1968 | Tracy et al. | 132/238 |
| 3,430,636 | 3/1969 | Compere | 132/238 |
| 3,605,762 | 9/1971 | Fromman | 132/238 |
| 3,612,070 | 10/1971 | Reyes | 132/238 |
| 3,696,820 | 10/1972 | Lara | 132/239 |
| 4,222,398 | 9/1980 | Fromman | 132/238 |

FOREIGN PATENT DOCUMENTS

| | | | |
|---|---|---|---|
| 1020226 | 2/1953 | France | 132/238 |

*Primary Examiner*—Kenneth J. Dorner
*Assistant Examiner*—J. Hakomaki
*Attorney, Agent, or Firm*—Albert O. Cota

[57] ABSTRACT

A hair roller and a curler rotating device which has a motor (24) and batteries (28) housing within a body (20). The motor shaft (26) penetrates the body at one end and has a tapered mandrel (34) attached that connects to a tapered bore (40) on the roller (36) allowing a removable connection. The curler (38) further has a clip (48) for holding the end of a lock of hair to start the rolling procedure. A clamp (56) holds the hair in place when the rotating device has finished the rolling process and rotates freely within the roller body. A second embodiment contains a slipable sleeve (58) and motor driven gear (70) in place of the mandrel and tapered bore that limits the torque of the motor to a predetermined value. This precludes pulling of ones hair when rotation is completed, overcoming previous attempts to solve the problem of excessive motor power.

9 Claims, 2 Drawing Sheets

HAIR ROLLER AND ROTATING APPARATUS

TECHNICAL FIELD

The present invention relates to hair curling devices in general, more particularly to hair curlers that have an integral clip holding the end of the hair in conjunction with a clamp holding the rolled hair having the rotation provided by a motor utilizing controlled torque or a slip clutch on the roller interface.

BACKGROUND ART

Previously, many types of curlers have been used in endeavoring to provide effective and comfortable means to curl hair. Also, numerous attempts have been made to use electric motors to wind the curler on the hair, as well as mechanical devices that manually change linear motion into rotary energy for the same purpose.

The problem with known prior art is the inability to attach the hair to the curler when it is wrapped around the curler without using a separate fastener, and also the inability to limit the torque of the motor at the completion of the winding procedure.

A search of the prior art did not disclose any patents that read directly on the claims of the instant invention, however, the following U.S. Pats. were considered related:

| U.S. Pat. No. | Inventor | Issue Date |
|---|---|---|
| 4,192,326 | Klinge | Mar. 11, 1980 |
| 3,612,070 | Reyes | Oct. 12, 1971 |
| 3,605,762 | Fromman | Sep. 20, 1971 |
| 3,463,169 | Zaidan | Aug. 26, 1969 |
| 3,413,984 | Tracy et al | Dec. 3, 1968 |
| 3,376,875 | Rosan | Apr. 9, 1968 |
| 3,953,138 | Nichol | Sep. 20, 1960 |
| 2,924,225 | Freeman | Feb. 9, 1960 |

Reyes teaches a power driven hand held curler that utilizes standard curlers by inserting a resilient mandrel inside, gripping and rotating the curler. When the curler is rolled, the device is removed and a fastener, such as a hairpin is applied holding the hair in place. A support stand is taught, including a battery recharger and curler roll storage.

Fromman teaches an electric powered roller with an alternating current motor that attaches the roller with a chucking device engaging the roller. Speed is controlled by a reostat switch allowing rotation to vary relative to the pressure applied to the switch. Again, containment of the hair to the roller is achieved by means well known in the art.

Tracy et al utilize a bifurcated head on the end of the shaft of a motor which grippingly engages the roller through spring pressure. Conventional hollow hair curlers are used with separate devices to maintain adherence of the rolled hair.

The remaining U.S. Pats. teach mechanical means to roll the curler around the hair and are included for background purposes and are indicative of the art to which this invention relates.

DISCLOSURE OF THE INVENTION

As it has been noted, prior art has realized the need to provide an automatic curler roller that eliminates the necessity to roll the curlers by hand or twist the hair over ones finger in order to set a curl. Attempts using commonly known hollow curlers with electrically driven apparatus have been faced with the problem of hair attachment, as it is still required to find the hairpin or clip and place it over the curler while the other hand is holding the assembly in place on the rolled hair. It is, therefore, a primary object of the invention to provide an integral clip within the roller cylinder that holds the initial lock of hair to the curler. When the brace of hair is rolled up with the battery operated gear motor a second integral clamp, having parallel arms and a C-shaped jaw, simply folds over the roller holding the hair allowing the rotating device to be easily removed. While the roller is revolving, the clamp rotates freely upon one end of the roller thereby keeping free from the hair or adjoining curlers.

An important object of the invention deals with solving the problem of excessive torque in the electric motor pulling the hair after the rolling has been completed. The instant invention utilizes two separate methods in the preferred and the second embodiment. The preferred embodiment employs curler attaching means using a cone shaped mandrel holding the roller to the motor, and the motor utilized has preselected torque. When the curler is completely rolled, the motor stalls at a torque of 1 inch ounce (0.072 kilogram centimeter), which is sufficient to rotate the curler, but will not pull the hair to reach the threshold of pain. The second embodiment utilizes an automatic slip clutch integral with the roller. This allows the motor to continue rotating until manually shut off, while the torque delivered to the rolled hair is governed by the mechanics of the roller. This clutch arrangement consists of a toothed gear on the motor shaft and a toothed sleeve on the curler. These elements mate together either internally or externally, according to the diameter, and the sleeve is retained into the curler with fingers having sufficient friction between the sleeve and the roller to maintain contact until optimum torque is delivered to the sleeve, at which point it automatically slips at the desired breakaway torque.

Another object of the invention allows the motor to be controlled in speed, within limits, and also direction, forward or reverse rotation. This allows the operator to have complete control of the device while setting a womans hair on the rollers.

Still another object of the invention is the utilization of a dry cell battery as the energy source. This allows freedom of movement without a cord to attach to a permanent power source and the batteries have sufficient life to accomplish many settings without replacement. Rechargeable batteries may also be used, prolonging the useful life of the batteries.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
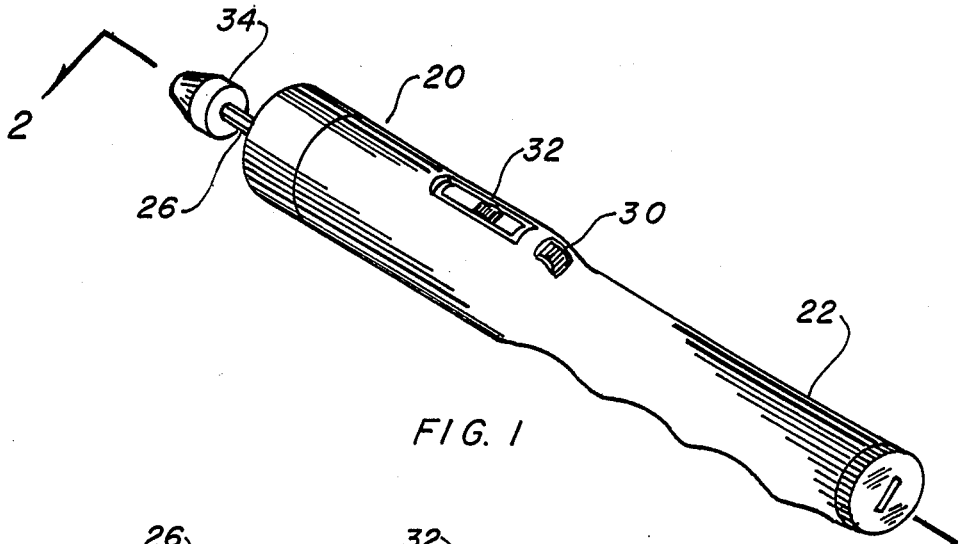
FIG. 1 is a partial isometric view of the preferred embodiment, of the rotating apparatus less the curler.
Figure 2:
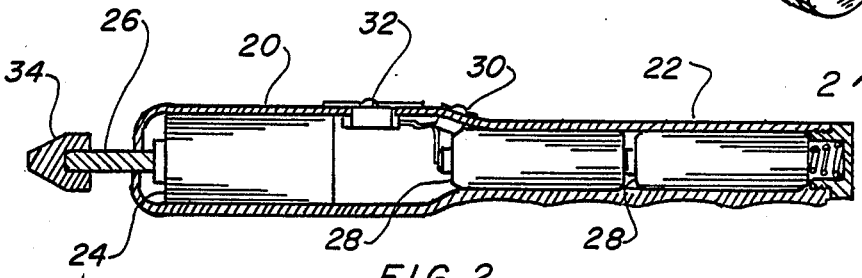
FIG. 2 is a cross-sectional view taken along lines 2—2 of FIG. 1.

The best mode for carrying out the invention is presented in terms of a preferred and a second embodiment. Both embodiments are primarily designed the same, the only difference is the curler attaching means varying the approach to control torque of the apparatus when the function is completed.

The preferred embodiment, as shown in FIGS. 1 through 5 is comprised of a body 20 in cylindrical shape with one end having a series of hollows conforming to the shape of ones hand. The first end, therefore, is used as a handle 22. The second end is somewhat larger in diameter and houses an electric reduction gear drive motor 24, with the motor shaft 26 extending linearly from the body 20. The body 20 is injection molded of a thermoplastic material, such as polyethylene, polypropylene, polystyrene, polycarbonate, cellulose, or the like, and is preferably formed in two or more pieces joined together. The motor 24 utilizes a speed reducing gear train changing the speed at a ratio of from 40 to 100:1, with 141:1 being preferred. A motor with a continuous output torque rating of 14.2 inch-ounce (1.02 kg-cm) has proven ideal for driving this apparatus.

The handle portion 22 of the body 20 contains a pair of dry type storage batteries 28 mounted in parallel abutment. These batteries may be the replaceable type or rechargeable with equal ease, either type supplying the means to store the requisite electrical energy to operate the motor. The batteries 28 are attached electrically to the motor 24 through insulated wires that are connected in series with a plurality of motor control switches mounted into the body 20. These switches include an on/off, forward and reverse switch 30 and a sliding three-stage potentiometer 32 that allows the resistance to be changed varying the speed of the motor. The speeds are marked fast, medium, and slow in the preferred embodiment, however, any variable resistor may be used equally well in the combination.

Curler attaching means are attached to the end of the motor shaft 26 and consist of a resilient truncated cone shaped mandrel 34. This shape allows gripping of mating surfaces by wedging while easy attachment and removal is achieved.

Figure 3:
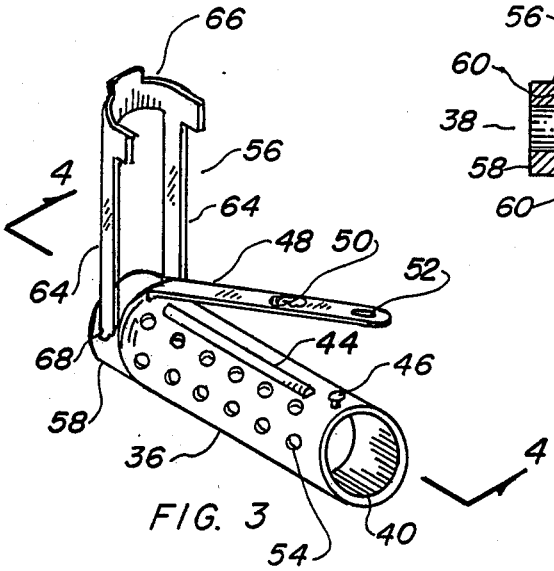
FIG. 3 is a partial isometric view of the preferred embodiment of the curler removed from the rotating apparatus clarity.
Figure 4:
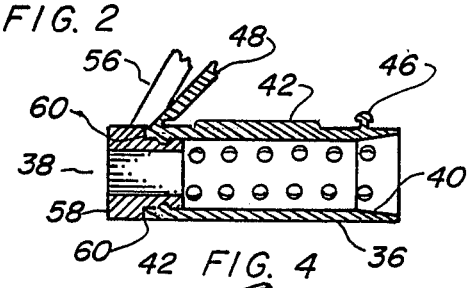
FIG. 4 is a cross-sectional view taken along lines 4—4 of 3.
Figure 5:
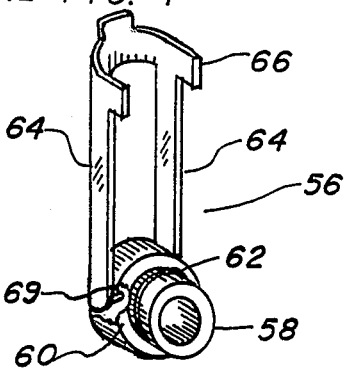
FIG. 5 is a partial isometric view of the hollow sleeve and clamp removed from the curler for clarity.

A hollow cylindrical roller 36 forming the body of a curler 38, best shown in FIGS. 3 and 4, is removably connected to the mandrel 34 on one end interfacing with an integral tapered bore 40. This roller 36 contains the tapered section on one end and a raised bead 42 on the inside near the other end. The roller 36 also has a rib 44 located longitudinally within approximately 80 to 90 percent of the entire body length. This rib 44 is in a radial shape projecting slightly from the surface of the roller 36. A locking peg 46 is formed integrally with the roller 36 and is in linear alignment with the rib 44 and is located on the tapered bore end. This peg 46 has an enlarged head that is radially shaped on the top with a flat shoulder underneath creating an attachment point under the head.

A clip 48 is also integrally formed with the roller 36 on one end and is attached to the roller near the beaded end and is in alignment with the rib 44. The clip 48 is in rectangular shape with the inside having a cavity 50 on the surface next to the roller when the clip is juxtaposed thereupon. The attached end of the clip 48 is narrowed in living hinge manner allowing the clip to move angularly to and from the roller 36. The other, or extended, end of the clip 48 contains a slot 52 near the extremity. In operation a lock or tuft of hair is placed on the curler 38 across the rib 44 and the clip 48 is snapped into position with the peg 46 penetrating the slot 52, holding the clip in place while the hair is retained between the tight interface between the rib 44 on the roller and the cavity 50 in the clip. The roller 36 is also provided with a plurality of holes 54 that allow air to penetrate through the hair rolled around the curler 38 accelerating the drying process.

In order to retain the hair once it is rolled onto the curler, a clamp 56 is provided. This clamp 56 consists of a hollow sleeve 58 having a stepped shoulder 60 on one end. The shoulder is slightly smaller in diameter than the inside of the roller 36 and has a radial groove 62. A pair of attached parallel arms 64 terminate into a C-shaped jaw 66. The arms 64 are integrally formed with the clamp 56 and have a portion near the intersection that is narrowed becoming a living hinge 68 allowing the entire clamp, including the arm to rotate parallel to the curler 38 in one position and at right angles at another. Another variation of this attachment instead of the living hinge 68, a pivot hinge 69 may be employed. This is shown pictorially in FIG. 5 and consists of projections from the arms 64 into holes in the sleeve 58 creating a pivotal joint. The sleeve 58 of the clamp 56 is disposed within the hollow bore of the roller 36 allowing free rotation between the elements while being captivated with the raised bead 42 interfacing with the groove 62. This allows the clamp 56 to rotate when hair is being wound on the outside of the roller 36, and when completed, the clamp 56 is snapped over the top with the parallel arms 64 on each side holding the hair, while the jaw 66 grips the outside of the roller 36 holding the assembly tightly in place.

Figure 6:
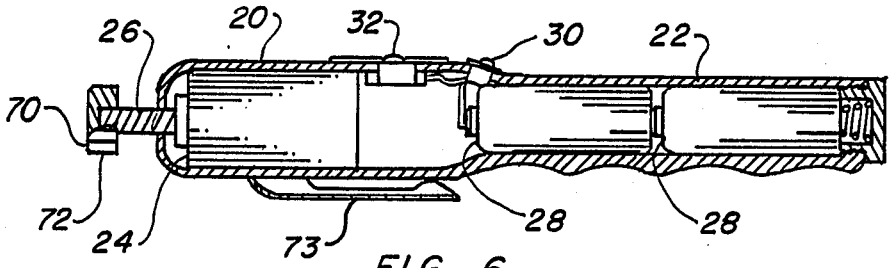
FIG. 6 is a sectional view of the second embodiment of the rotating apparatus taken along the centerline thereof.
Figure 7:
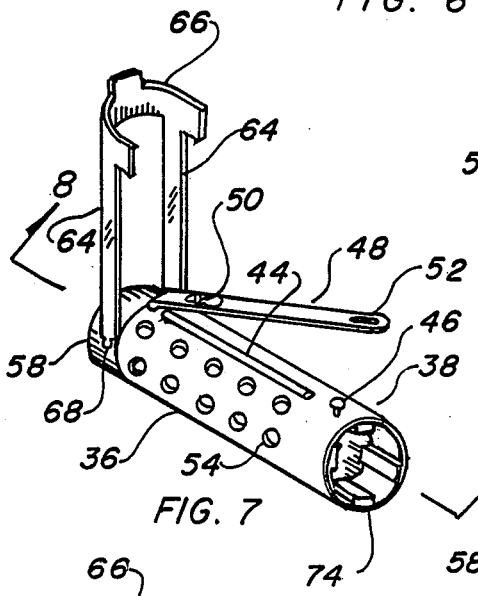
FIG. 7 is a partial isometric view of the preferred embodiment of the curler removed from the rotating apparatus for clarity.
Figure 8:
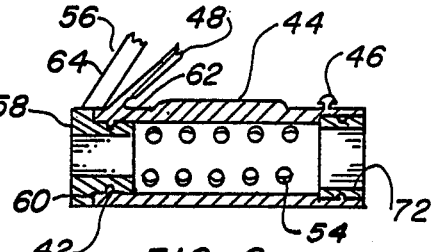
FIG. 8 is a cross-sectional view taken along lines 8—8 of FIG. 7.
Figure 10:
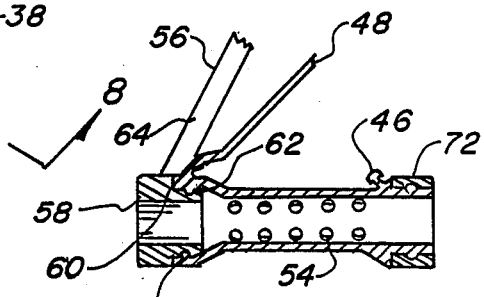
FIG. 10 is a cross-sectional view taken along lines 10—10 of 9.
Figure 9:
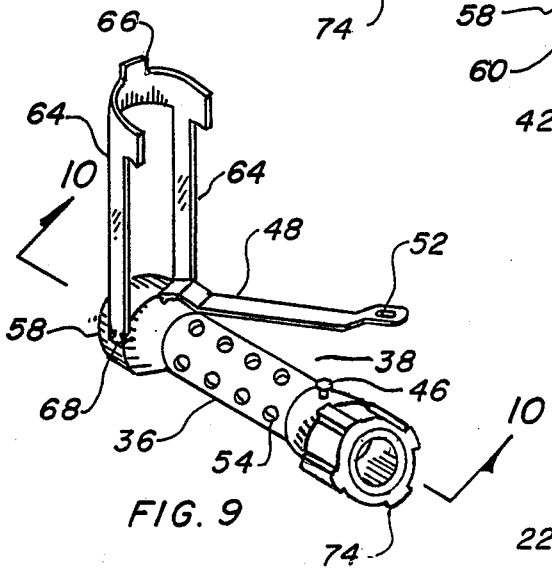
FIG. 9 is a partial isometric view of a small diameter curler, removed from the rotating apparatus for clarity.
Figure 12:
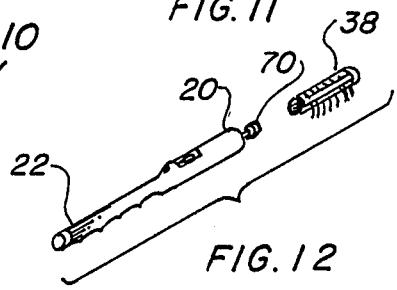
FIG. 12 is an exploded view of the invention with a lock of hair rolled and clamped on the curler, and the rotating apparatus removed.

The second embodiment is identical to the preferred embodiment in all respects, except the curler attaching means. Instead of the tapered mandrel 34 and the tapered bore 40 on the roller making the connection, the motor shaft 26 is furnished with a gear 70 having a plurality of teeth 72. The curler 38 contains a toothed sleeve 74 that is retained on the end of the roller 36. The joint is sized such that sufficient friction between the sleeve 74 and the roller 36 is provided to allow the entire curler 38 to revolve receiving hair on the outside until completely rolled up where the torque increases and slipping occurs sufficient to stop the rotation of the roller 36. It has been determined that the optimum torque created by the frictional resistance is inch-ounce (.072 kg/cm). This automatic rotational termination allows the operator to turn the motor 24 off without the danger of pulling the recipients hair, therefore, this embodiment is applied in a professional establishment. The less complicated and, therefore, less expensive preferred embodiment is utilized by the individual user. The second embodiment is pictorially illustrated in FIGS. 6 through 8 and employs the teeth 72 on the outside of the gear 70 and on the inside of the toothed sleeve 74 on the curler. Further, the sleeve 74 is positioned on the outside of the roller 36. A variation of the second embodiment is shown in FIGS. 9 and 10 and differs in that the teeth 72 on the gear 70 are on the inside, and the teeth on the sleeve are on the outside. This allows a much smaller roller 36 to be used and the friction joint remains the same, only the method of attachment changes. FIG. 12 illustrates the internal teeth of the gear 70.

Figure 11:
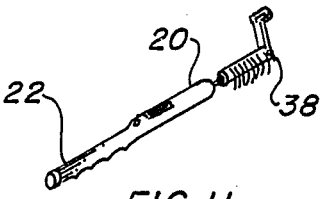
FIG. 11 is a partial isometric view of the invention showing a lock of hair held under the influence of the clip prior to rolling.

The operation of each element of the apparatus has been sequentially explained, however, FIGS. 11 and 12 show the hair at the start of the procedure and when the roll is completed with the clamp 56, secured and the rotating apparatus removed.

If desired, a pocket clip 73 may be added to the body 20 to retain the curler during usage.

While the invention has been described in complete detail and pictorially shown in the accompanying drawings, it is not to be limited to such details, since many changes and modifications may be in the invention without departing from the spirit and the scope thereof. Hence, it is described to cover any and all modifications and forms which may come within the language and scope of the appended claims.

I claim:

1. A hair roller and power driven self-contained rotating apparatus comprising:

(a) a body in cylindrical shape having a first and second end with said first end forming a handle to be gripped thereupon;

(b) an electric reduction gear drive motor disposed within the second end of the body having a drive shaft extending linearly therefrom providing the rotational force for the apparatus;

(c) means to store electrical energy contained within said handle portion of the body supplying electrical power to the motor providing self-contained torsional force;

(d) a plurality of motor control switches mounted in the body electrically energizing the motor, also regulating its direction and speed;

(e) roller attaching means drivingly mounted onto the end of said motor drive shaft providing a connecting interface thereupon;

(f) a hollow cylindrical roller forming the body of a curler having means to receive on one end and a raised bead inside the hollow portion near the end on the other, also a rib extending axially along from 80 to 90 percent of the rollers length, said roller removably connected onto said roller attaching means, for wrapping ones hair on the periphery thereof during hair setting procedures in order to produce curls;

(g) a locking peg extending from said roller near said body second end for attachment;

(h) a clip integral with said roller having an extended and an attached end and a slot near the extended end and a narrow portion at the attached end forming a living hinge axially juxtapositioned with said roller, further, said clip having a cavity on the side next to said roller formed in such a manner as to tightly interface with said rib on the roller when the slot snappingly engages said locking peg for attaching the ends of ones hair to the roller prior to rolling; and, (i) a clamp having a hollow sleeve with a stepped shoulder on one end, the shoulder slightly smaller in diameter than said cylindrical roller and said shoulder having a groove therein, also a pair of parallel arms integral with said sleeve terminating into a C-shaped jaw, said sleeve rotatably disposed within the hollow bore of the roller grippingly interfacing the groove with said raised bead in the roller bore retaining the clamp into the roller, allowing the clamp to rotate freely prior to engagement, further the arms engagingly distend on either side of the roller with the jaw gripping the roller holding the arms removably in place, thereby holding rolled hair on the outside of the roller when rotation of the roller attached to the rotating apparatus is completed.

2. The rotating apparatus as recited in claim 1 wherein said means to store electrical energy further comprises a plurality of dry type storage batteries housed within the handle of the body, the batteries abutting each other in parallel arrangement.

3. The rotating apparatus as recited in claim 2 wherein said motor control switches further comprise an on/off, forward and reverse switch wired to said motor and batteries providing energization and directional control of the motor, and a sliding, three-stage potentiometer to vary the speed of the motor to either fast, medium, or slow speed.

4. The hair roller and rotating apparatus as recited in claim 1 wherein said attaching means further comprise a resilient truncated cone-shaped mandrel on said motor drive shaft wedged into said receiving means on one end of said roller defining a gripping, yet removable interface therebetween.

5. The hair roller and rotating apparatus as recited in claim 4 wherein said receiving means of said roller further comprise a tapered bore within said hollow roller configured in such a manner as to receive said cone shaped mandrel on the shaft providing a removable, yet tight fit therebetween allowing the curler to be secured on the end of the rotating apparatus for winding ones hair thereon and removable when rotation completed.

6. The hair roller and rotating apparatus as recited in claim 1 wherein said attaching means further comprise a gear having a plurality of teeth on the outside thereof attached to said motor shaft engaging said receiving means on the end of said roller defining a removable interface therebetween.

7. The hair roller and rotating apparatus as recited in claim 6 wherein said means to receive of said roller further comprise an internally toothed sleeve retained within the end of said roller having sufficient friction between the sleeve and the roller to allow the entire curler to revolve, receiving ones hair on the outside until the hair is completely wound stopping rotation with the torque reaching a predetermined value slipping the sleeve rotatably within the roller while still being driven by the gear of the motor shaft until the motor is manually deenergized.

8. The hair roller and rotating apparatus as recited in claim 1 further comprising; said roller having a plurality of holes to allow air to pass freely through rolled hair into the hollow cylindrical body assisting in hair drying, and said clamp parallel arms on said sleeve having a portion near the intersection therebetween narrowed creating a living hinge allowing the arms to rotate parallel to the sleeve is one position and at right angles in the other.

9. The hair roller and rotating apparatus as recited in claim 1 further comprising; said roller having a plurality of holes to allow air to pass freely through rolled hair into the hollow cylindrical body assisting in hair drying, and a pivot hinge on said clamp parallel arms interfacing with said sleeve allowing the arms to rotate parallel to the sleeve in one position and at right angles in the other.

* * * * *